US008522994B2

(12) United States Patent
Weiler et al.

(10) Patent No.: US 8,522,994 B2
(45) Date of Patent: Sep. 3, 2013

(54) HERMETICALLY SEALED CONTAINER

(75) Inventors: Gerhard H. Weiler, Woodstock, IL (US); Kathleen E. Kurek, Des Plaines, IL (US)

(73) Assignee: Weiler Engineering, Inc., Elgin, IL (US)

( * ) Notice: Subject to any disclaimer, the term of this patent is extended or adjusted under 35 U.S.C. 154(b) by 10 days.

(21) Appl. No.: 13/068,327

(22) Filed: May 9, 2011

(65) Prior Publication Data

US 2012/0285964 A1 Nov. 15, 2012

(51) Int. Cl.
*B65D 17/40* (2006.01)
*B65D 41/32* (2006.01)

(52) U.S. Cl.
USPC ..... 220/276; 215/256

(58) Field of Classification Search
USPC ..... 220/276, 266, 265, 270, 285, 836, 220/810, 200; 215/256, 254, 253, 250, 305, 215/390, 48, 47, 200; 222/153.07, 153.06, 222/153.05, 541.9, 541.6
IPC ..... B65D 17/40,41/32
See application file for complete search history.

(56) References Cited

U.S. PATENT DOCUMENTS

| | | | | |
|---|---|---|---|---|
| 3,597,793 | A * | 8/1971 | Weiler et al. | 425/317 |
| 4,178,976 | A * | 12/1979 | Weiler et al. | 604/415 |
| 4,207,990 | A * | 6/1980 | Weiler et al. | 220/267 |
| 4,540,542 | A * | 9/1985 | Weiler | 264/524 |
| 4,566,613 | A * | 1/1986 | Anscomb | 222/541.9 |
| 4,872,571 | A * | 10/1989 | Crecelius et al. | 222/541.1 |
| 5,203,838 | A * | 4/1993 | Schneider | 215/253 |
| 5,246,126 | A * | 9/1993 | Lewis, Jr. | 215/303 |
| 5,878,900 | A * | 3/1999 | Hansen | 215/50 |
| 2004/0182883 | A1* | 9/2004 | Weiler | 222/153.07 |
| 2006/0175279 | A1* | 8/2006 | Miller et al. | 215/48 |
| 2009/0008354 | A1* | 1/2009 | Weiler et al. | 215/247 |

* cited by examiner

*Primary Examiner* — Robert J Hicks
(74) *Attorney, Agent, or Firm* — Olson & Cepuritis, Ltd.

(57) ABSTRACT

A hermetically sealed thermoplastic container having a dispensing nozzle occluded by a unitary but removable cap is provided with at least one fin alongside the dispensing nozzle. The fin is situated adjacent to the cap so that the rim of the cap can engage the fin to facilitate removal of the cap from the container.

13 Claims, 5 Drawing Sheets

HERMETICALLY SEALED CONTAINER

FIELD OF INVENTION

This invention relates to hermetically sealed thermoplastic container.

BACKGROUND ROUND OF THE INVENTION

Hermetically sealed containers manufactured by the so-called blow-fill-seal method have enjoyed widespread acceptance for dispensing liquid medicaments and the like. Depending upon the thermoplastic material utilized to fabricate such containers, sometimes considerable force is required to open the container, i.e., to sever the unitary cap that occludes the dispensing aperture of the container.

It would be desirable to provide a hermetically sealed thermoplastic container with an easily removable cap or closure. The present invention provides such a container.

SUMMARY OF THE INVENTION

A hermetically sealed container made of a thermoplastic material, such as polypropylene, and the like is provided with a trigger feature that facilitates the opening of the container in order to gain access to container contents.

The hermetically sealed container embodying the present invention has a body portion that defines a predetermined volume, and a neck portion that is unitary with the body portion and terminates in a dispensing nozzle that defines a container access aperture. The dispensing nozzle may be aligned with the longitudinal axis of the container or offset therefrom.

A removable cap, unitary with the dispensing nozzle occludes the dispensing nozzle and the container access aperture. The removable cap is connected at its rim to the dispensing nozzle by a frangible web that is unitary with the cap as well as with the dispensing nozzle and circumscribes the access aperture.

The removable cap has an elongated tab or trigger that is unitary with the cap and extends across at least a major part of the container neck portion. A fin unitary with the container neck portion and the nozzle extends along the nozzle and is positioned adjacent the rim of the removable cap for engagement therewith when the tab or trigger is manipulated in a direction generally along the longitudinal axis of the nozzle. Manipulation of the tab severs the frangible web and permits removal of the cap to gain access to container contents. A pair of opposed fins can be provided as well, if desired.

DESCRIPTION OF THE PREFERRED EMBODIMENTS

Figure 1:
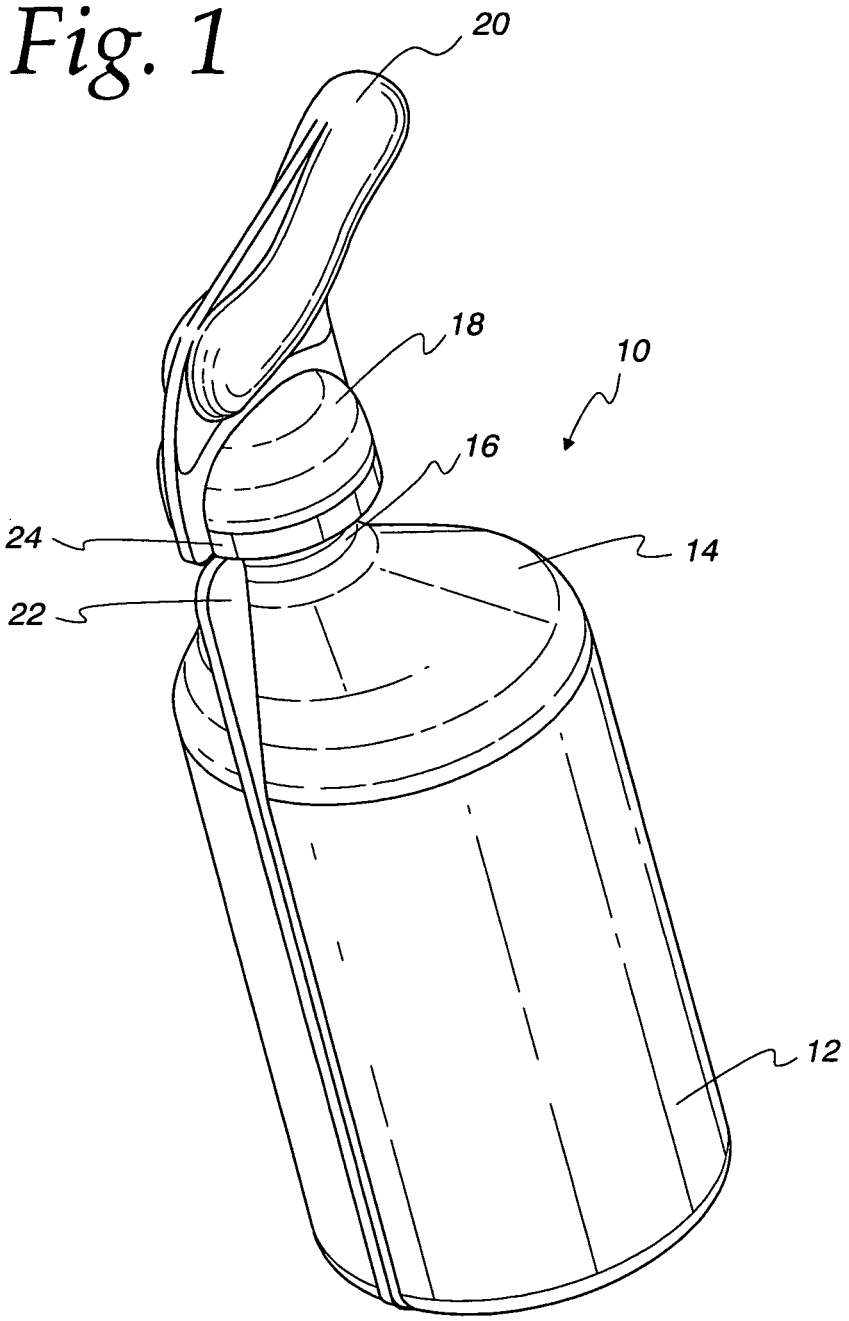
FIG. 1 is a perspective view of a hermetically sealed container embodying the present invention.
Figure 2:
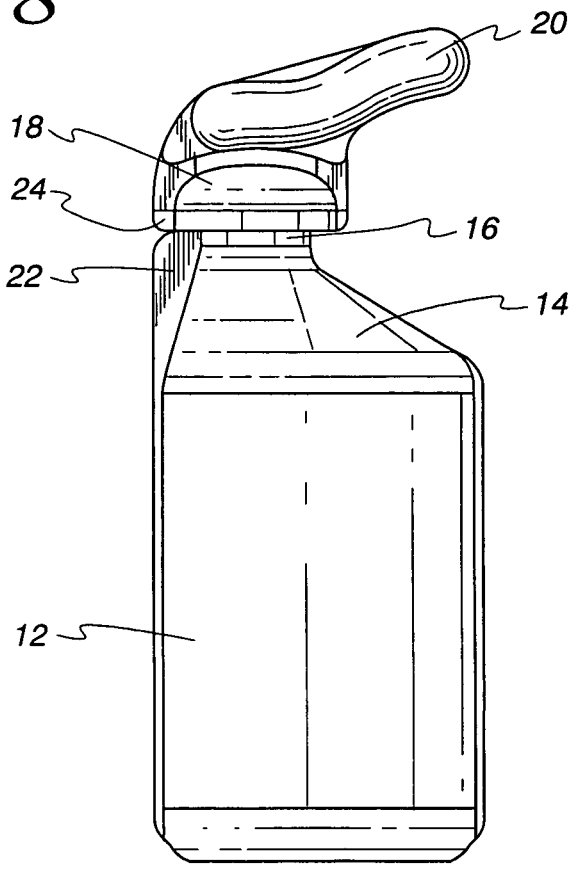
FIG. 2 is a side elevational view of the container shown in FIG. 1.

Referring to the drawings, FIGS. 1 and 2 show hermetically sealed container 10 made of a thermoplastic material such as polypropylene, high density polyethylene (HDPE), and the like. Container 10 has a body portion 12 and neck portion 14 unitary with body portion 12. Neck portion 14 terminates in dispensing nozzle 16 offset from body portion 12 and unitary with the neck portion. Longitudinal axis of dispensing nozzle 16 can be offset from the longitudinal axis of container body portion 12, or it can be the same. Fin 22 extends along side of neck 14 and nozzle 16. Removable cap 18 occludes dispensing nozzle 16 and is provided with elongated tab 20 that extends away from cap 18 and across at least a part of neck portion 14. Tab 20 is rounded and unitary with cap 18. Rim 24 of cap 18 is adjacent to fin 22 and connected to dispensing nozzle 16 by a frangible web 26 (FIGS. 3 and 4) which circumscribes an aperture defined by nozzle 16 and is broken by manipulation of tab 20 so that rim 24 engages fin 22 as will be discussed in detail below.

Figure 3:
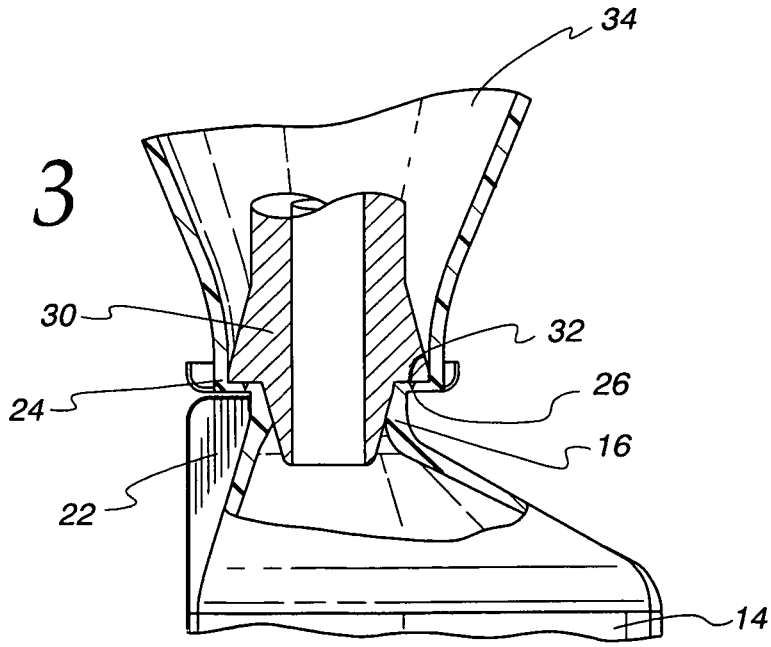
FIG. 3 is an enlarged fragmentary view, partly in section, illustrating formation of a frangible web between the dispensing nozzle and the removable cap.
Figure 4:
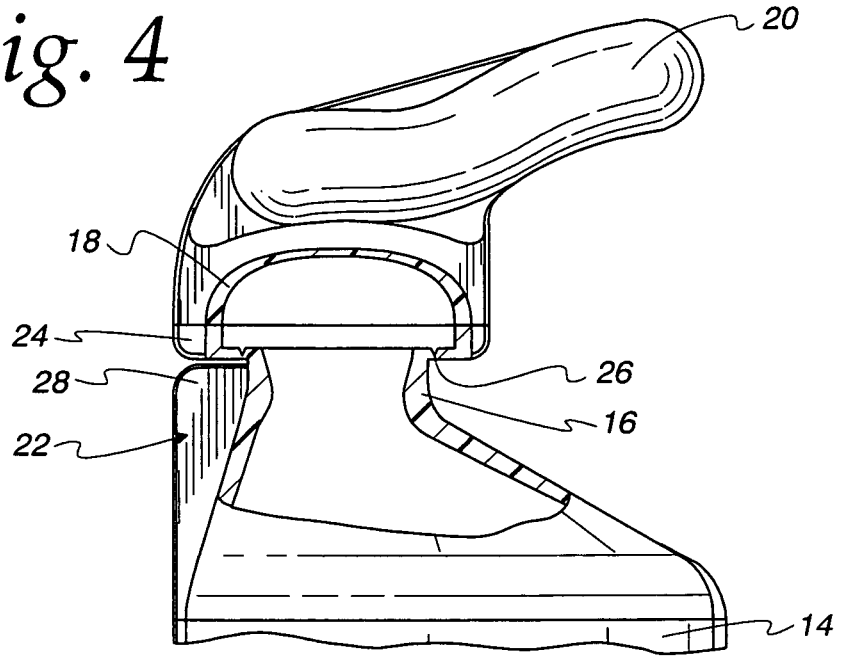
FIG. 4 is an enlarged, fragmentary view, partly in section, showing a unitary closure for a hermetically sealed container that embodies the present invention.

As best seen in FIGS. 3 and 4, frangible web 26 surrounds nozzle 16 and is unitary with cap 18 as well as with nozzle 16.

FIG. 3 also illustrates a method for forming frangible web 26. Filling and forming mandrel 30 is provided with a circular knife edge 32 which partially penetrates a still soft portion of parison 34 as the inside diameter of dispensing nozzle is molded by mandrel 30 during the forming and filling process of the thermoplastic container. After the container forming and filling process is complete, mandrel 30 is removed and the formed and filled container is sealed by forming cap 18 and tab 20 unitary therewith. The container forming, and sealing procedure is well known and is generally described in U.S. Pat. No. 3,597,793 to Weiler et al.

Figure 5:
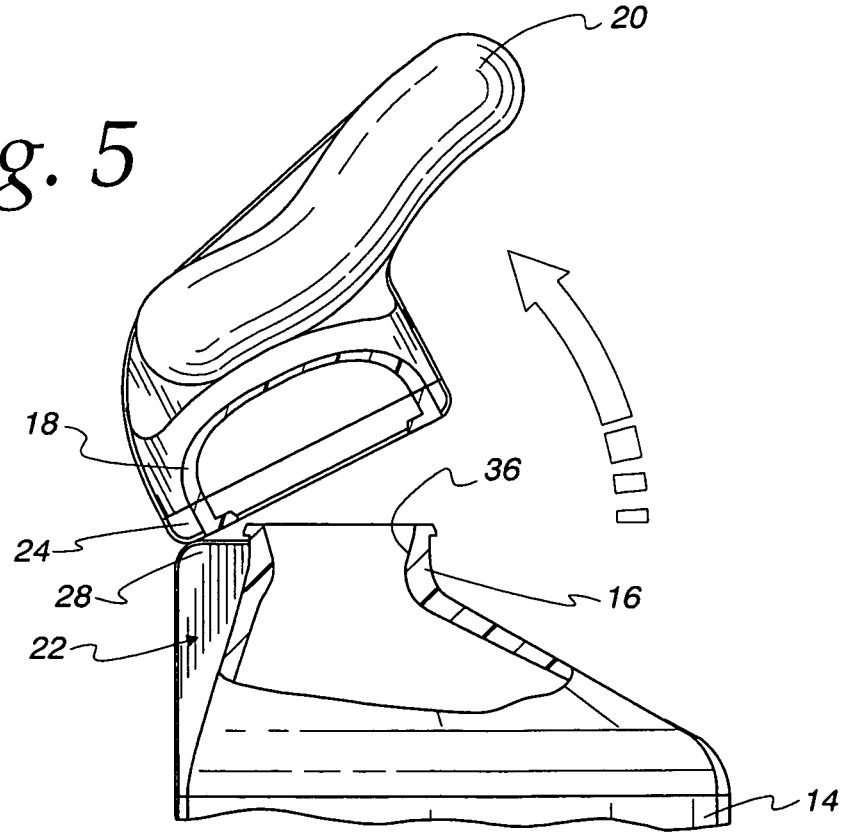
FIG. 5 is an enlarged, fragmentary view illustrating removal of the cap from the hermetically sealed container utilizing a feature of the present invention.

Frangible web 26 is radially spaced from rim 24 so that rim 24 can abut top portion 28 of fin 22 when tab 20 is manipulated. When rim 24 contacts top portion 28 of fin 22 upon an upwardly manipulation of tab 20, further upwardly force exerted upon tab 20 will cause frangible web 26 to break and permitting removal of cap 18 and exposing aperture 36 of nozzle 16 (FIG. 5).

The inside configuration and diameter of dispensing nozzle 16 is determined by the dimensions of mandrel 30. The inside passage of nozzle 16 can be provided with a Luer taper to accommodate a hypodermic syringe and the like.

Figure 6:
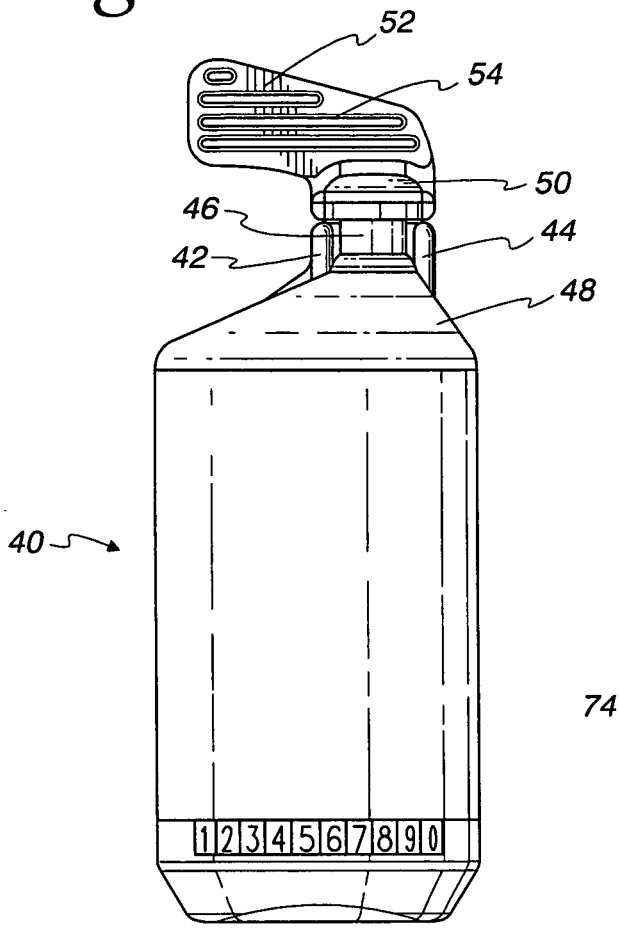
FIG. 6 is a side elevational view illustrating an alternate embodiment of the present invention.

To provide leverage facilitating the severance of frangible web 26 upon application of an upwardly or downwardly force to tab 20, a pair of opposed fins can be provided at the dispensing nozzle as shown in FIG. 6 where container 40 is shown having opposed fins 42 and 44 unitary with dispensing nozzle 46 and neck portion 48.

Tab 52 on unitary cap 50 has a substantially flat configuration and is provided with embossed spaced bar pattern 54 to facilitate gripping.

Figure 7:
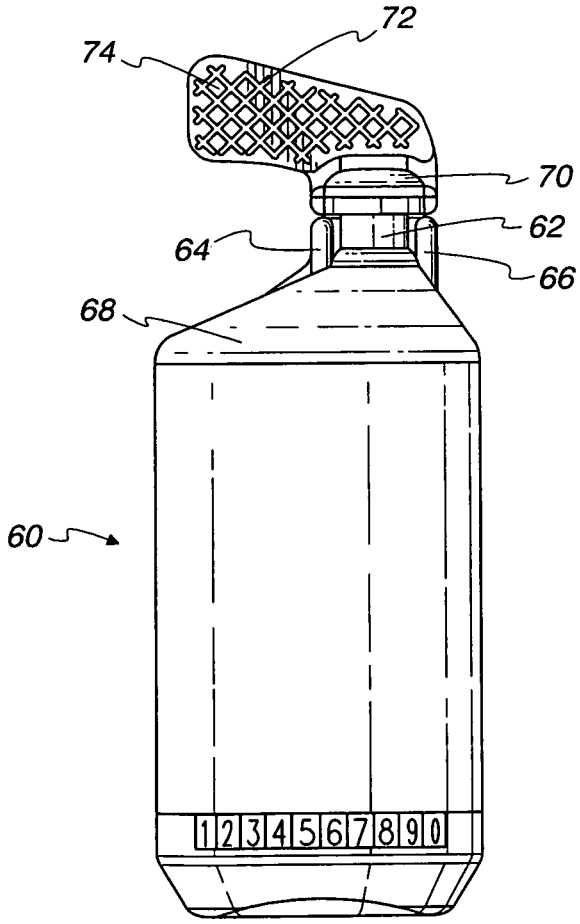
FIG. 7 is a side elevational view illustrating yet another embodiment of the present invention.
Figure 8:
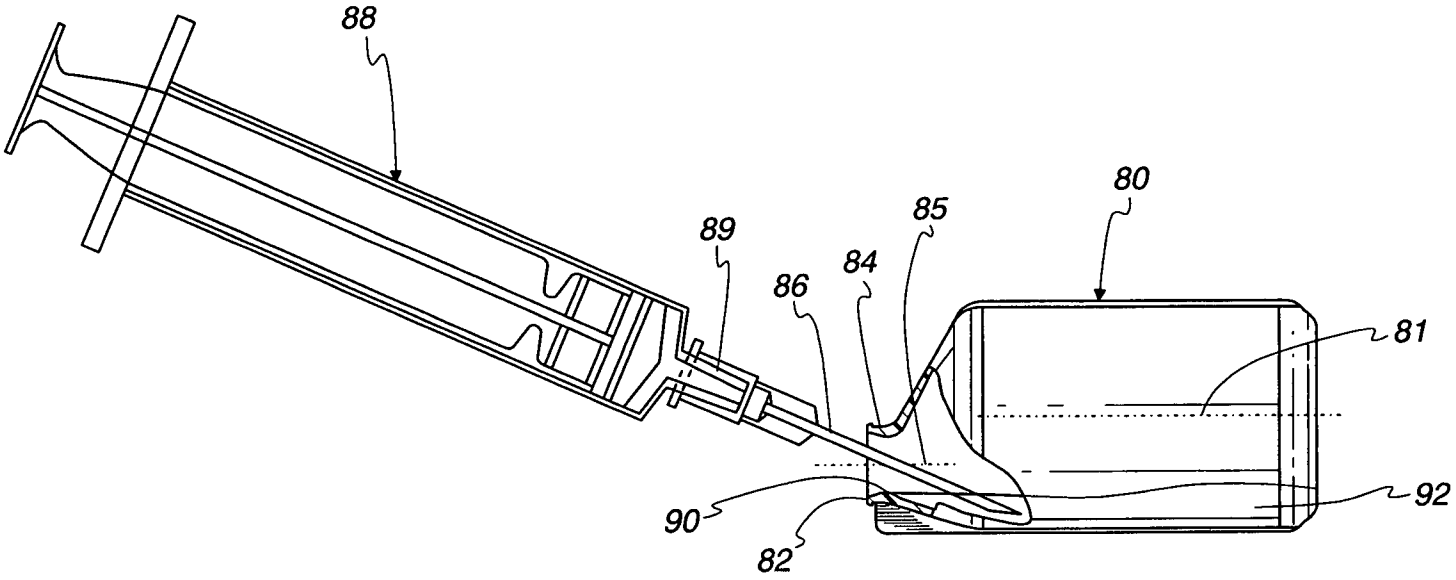
FIG. 8 illustrates an additional feature of the invention.

Yet another embodiment of the present invention is illustrated in FIG. 7 which shows hermetically sealed container 60 having an offset dispensing nozzle 62 flanked by opposing fins 64 and 66 unitary with nozzle 62 and container neck portion 68. The offset dispensing nozzle facilitates withdrawal of container contents with a syringe as illustrated in FIG. 8. Cap 70 occludes the dispensing aperture defined by nozzle 62 and is provided unitary tab 72 with an embossed, reticulated gripping surface 74 on both sides of tab 72.

Referring to FIG. 8, container 80 having a longitudinal axis 81 is shown in a substantially horizontal position with its unitary but removable cap removed, exposing aperture 82 of dispensing nozzle 84. The longitudinal axis 85 of dispensing nozzle 84 is offset from the longitudinal axis 81 of container 80. Needle 86 of hypodermic syringe 88 is shown entering the passageway 90 defined by dispensing nozzle 84 to reach and withdraw aliquots of container contents 92.

Alternatively, hub 89 of syringe 88 can mate with the Luer taper of passageway 90 to withdraw container contents.

Containers embodying the present invention can be formed, filled and sealed under sterile or aseptic conditions using techniques known in the art as described in U.S. Pat. No. 4,178,976 to Weiler et al. Suitable thermoplastic materials of construction are polypropylene (PP), high density polyethylene (HDPE), low density polyethylene (LDPE), and the like.

The foregoing description and the drawings are illustrative of the invention, but are not to be taken as limiting. Still other variants within the spirit and scope of this invention are possible and will readily present themselves to those skilled in the art.

We claim:

1. A hermetically sealed container of a thermoplastic material and comprising:

a body portion having a longitudinal axis;

a neck portion unitary with the body portion and terminating in a dispensing nozzle having a longitudinal axis;

a removable cap unitary with and occluding the dispensing nozzle, and having a rim connected to the dispensing nozzle by a frangible web;

an elongated tab unitary with the cap and extending across at least a part of the neck portion; and a fin unitary with the neck portion and the nozzle, the fin being positioned adjacent to the rim for engagement therewith when the tab is manipulated in a direction generally along the longitudinal axis of the nozzle.

2. The hermetically sealed container in accordance with claim 1 and having a pair of opposed fins unitary with the neck portion and the nozzle, and positioned adjacent to the rim for engagement therewith when the tab is manipulated along the longitudinal axis of the nozzle.

3. The hermetically sealed container in accordance with claim 1 wherein the thermoplastic material is polypropylene.

4. The hermetically sealed container in accordance with claim 1 wherein the elongated tab is flat and is embossed with a spaced bar pattern.

5. The hermetically sealed container in accordance with claim 1 wherein the elongated tab is rounded.

6. The hermetically sealed container in accordance with claim 1 wherein the elongated tab is flat and is embossed with a reticulated pattern.

7. The hermetically sealed container in accordance with claim 1 wherein the longitudinal axis of the dispensing nozzle is offset from the longitudinal axis of the container.

8. The hermetically sealed container in accordance with claim 1 wherein the dispensing nozzle defines a Luer taper.

9. A hermetically sealed container of a thermoplastic material and comprising:

a body portion having a longitudinal axis;

a neck portion unitary with the body portion and terminating in a dispensing nozzle having a longitudinal axis;

a removable cap unitary with and occluding the dispensing nozzle; and having a rim connected to the dispensing nozzle by a frangible web;

an elongated tab unitary with the cap and extending across at least a part of the neck portion; wherein the longitudinal axis of the nozzle is parallel to but offset from the longitudinal axis of the container, and a fin unitary with the neck portion and the nozzle, the fin being positioned adjacent to the rim for engagement therewith when the tab is manipulated in a direction generally along the longitudinal axis of the nozzle.

10. The hermetically sealed container in accordance with claim 9 wherein the thermoplastic material is polypropylene.

11. The hermetically sealed container in accordance with claim 9 wherein the elongated tab is flat and is embossed with a spaced bar pattern.

12. The hermetically sealed container in accordance with claim 9 wherein the elongated tab is rounded.

13. The hermetically sealed container in accordance with claim 9 wherein the elongated tab is flat and is embossed with a reticulated pattern.

* * * * *